US010428644B2

(12) United States Patent
Hull et al.

(10) Patent No.: US 10,428,644 B2
(45) Date of Patent: Oct. 1, 2019

(54) SOUND BAFFLE DEVICE AND SYSTEM FOR DETECTING ACOUSTIC SIGNALS

(71) Applicant: Hifi Engineering Inc., Calgary (CA)

(72) Inventors: John Hull, Calgary (CA); Neil Gulewicz, Calgary (CA); Seyed Ehsan Jalilian, Calgary (CA)

(73) Assignee: Hifi Engineering Inc., Calgary, Alberta (CA)

( * ) Notice: Subject to any disclaimer, the term of this patent is extended or adjusted under 35 U.S.C. 154(b) by 362 days.

(21) Appl. No.: 15/105,386

(22) PCT Filed: Dec. 15, 2014

(86) PCT No.: PCT/CA2014/051213
§ 371 (c)(1),
(2) Date: Jun. 16, 2016

(87) PCT Pub. No.: WO2015/089658
PCT Pub. Date: Jun. 25, 2015

(65) Prior Publication Data

US 2016/0312604 A1 Oct. 27, 2016

Related U.S. Application Data

(60) Provisional application No. 61/917,124, filed on Dec. 17, 2013.

(51) Int. Cl.
*E21B 47/10* (2012.01)
*E21B 41/00* (2006.01)
*G10K 11/00* (2006.01)

(52) U.S. Cl.
CPC ..... *E21B 47/101* (2013.01); *E21B 41/00* (2013.01); *G10K 11/002* (2013.01)

(58) Field of Classification Search
CPC ..... E21B 47/101; E21B 47/024; E21B 41/00; E21B 23/14; G10K 11/002; G10K 11/00;
(Continued)

(56) References Cited

U.S. PATENT DOCUMENTS 5,318,129 A * 6/1994 Wittrisch ..... E21B 23/14 166/336
5,467,825 A * 11/1995 Vallet ..... E21B 33/0422 166/208

(Continued)

FOREIGN PATENT DOCUMENTS

| | | | |
|---|---|---|---|
| CA | 2692937 | A1 | 8/2010 |
| CN | 102881280 | A | 1/2013 |
| WO | WO2013/163471 | A1 | 10/2013 |

OTHER PUBLICATIONS

International Search Report and Written Opinion of the International Searching Authority, dated Apr. 7, 2015, for corresponding International Application No. PCT/CA2014/051213, 7 pages.

*Primary Examiner* — George S Gray
(74) *Attorney, Agent, or Firm* — Klarquist Sparkman, LLP

(57) ABSTRACT

A sound baffle device for use with an acoustic sensor deployed in a housing by a deployment line comprises a radially extending baffle plate and an affixing mechanism for affixing the baffle plate to the deployment line. The baffle plate is configured to reduce acoustic transmission between a first zone of the housing on one side of the baffle plate and a second zone of the housing on an opposite side of the baffle plate.

14 Claims, 14 Drawing Sheets

(58) Field of Classification Search
CPC ..... Y10S 367/901; Y10S 367/911; Y10S 367/912
See application file for complete search history.

(56) References Cited

U.S. PATENT DOCUMENTS

| | | | | |
|---|---|---|---|---|
| 6,192,983 | B1 * | 2/2001 | Neuroth | E21B 17/028 166/250.15 |
| 2007/0215345 | A1 * | 9/2007 | Lafferty | E21B 43/26 166/250.1 |
| 2008/0078561 | A1 * | 4/2008 | Chalker | E21B 33/1208 166/387 |

* cited by examiner

SECTION A-A

SOUND BAFFLE DEVICE AND SYSTEM FOR DETECTING ACOUSTIC SIGNALS

CROSS REFERENCE TO RELATED APPLICATIONS

This is the U.S. National Stage of International Application No. PCT/CA2014/051213, filed Dec. 15, 2014, which in turn claims the benefit of and priority to U.S. Provisional Application No. 61/917,124, filed Dec. 17, 2013. The provisional application is incorporated herein in its entirety.

TECHNICAL FIELD

This disclosure relates generally to a sound baffle device for use with an acoustic sensor and to a system for detecting acoustic signals in a zone of interest in a housing.

BACKGROUND

Fluid migration in oil or gas wells is generally referred to as "casing vent flow" (CVF) or "gas migration" (GM) and can refer to any one or more of the following phenomena:

- Fluid flowing from the formation into an outermost annular portion of the wellbore behind an outermost casing string in the wellbore;
- Fluid flowing from the outermost annular portion of the wellbore into the formation; and
- Fluid flowing across any of the casing or tubing strings in the wellbore.

Fluid includes gas or liquid hydrocarbons, including oil, as well as water, steam, or a combination thereof. Any fluid migration will produce an "acoustic signal". Acoustic signals resulting from the migration of fluid may be used as an identifier, or "diagnostic", of a leaking well. For example, gas may migrate as a bubble from the source up towards the surface, frequently taking a convoluted path that may progress into and/or out of the production casing, the surrounding earth strata and the cement casing of the wellbore, and may exit into the atmosphere through a vent in the well, or through the ground. As the bubble migrates, pressure may change and the bubble may expand or contract and may increase or decrease its rate of migration and produce an acoustic event.

Fibre optic cables, acoustic sensor arrays and other acoustic sensing tools can be deployed downhole for detecting acoustic signals and locating fluids leaking from the wellbore. The acoustic sensing tools capture and detect acoustic signals and translate these signals to optical energy to provide a well profile. The acoustic data can be digitally processed by software algorithms to determine the origin of different sounds in the well and separate nuisance data from useful data allowing the location of the leak to be pinpointed.

Loud sounds can be caused for example by well surface equipment, the flow of water in an underground stream located above or below the tool location, a loud gas leak above or below the tool location, etc. These loud sounds can often overshadow sounds generated near the tool location to the point where the software algorithms may be incapable of detecting the presence of a sound event of interest.

SUMMARY

According to a first aspect there is provided a sound baffle device for use with an acoustic sensor deployed in a housing by a deployment line. The sound baffle device comprises a radially extending baffle plate and an affixing mechanism for affixing the baffle plate on the deployment line. The baffle plate is configured to reduce acoustic transmission between a first zone of the housing on one side of the baffle plate and a second zone of the housing on an opposite side of the baffle plate.

The baffle plate may have an aperture therethrough for receiving the deployment line and the affixing mechanism may comprise a first and second stopper configured to be positioned on the deployment line either side of the baffle plate such that in use the baffle plate is retained on the deployment line between the first and second stopper. The aperture of the baffle plate may be dimensioned to allow rotation of the baffle plate around the deployment line.

The affixing mechanism may alternatively comprise a body configured to attach the baffle plate to the deployment line. The body may comprise two or more sections and a fastener for fastening the sections together around the deployment line. The fastener may releasably fasten the sections together around the deployment line. The device may further comprise a baffle plate assembly for attaching the baffle plate to the body. The baffle plate assembly may releasably attach the baffle plate to the body.

The affixing mechanism may alternatively comprise a compressible packing configured to compress and retain the baffle plate on the deployment line. The affixing mechanism may further comprise a retainer and a compressor. The packing may be positioned between the retainer and the baffle plate and the compressor may be configured to move the retainer towards the baffle plate and compress the packing therebetween. A first compressible packing may be positioned on one side of the baffle plate and a second compressible packing may be positioned an opposed side of the baffle plate. A first and second retainer may be positioned either side of the first and second packing and the compressor may be configured to move the first and second retainer towards each other to compress the first and second packing therebetween.

According to another aspect, there is provided a method of reducing acoustic transmission between a first zone of a wellbore and a second zone of a wellbore, the method comprising deploying the sound baffle device of the first aspect down the wellbore and positioning the sound baffle device between the first zone and the second zone to reduce acoustic transmission therebetween.

According to another aspect, there is provided a method of reducing acoustic transmission between a first zone of a housing and a second zone of the housing, the method comprising positioning the sound baffle device of the first aspect between the first zone and the second zone to reduce acoustic transmission therebetween.

According to another aspect, there is provided a system for detecting acoustic signals in a zone of interest in a housing. The system comprises an acoustic sensor positioned in the zone of interest and one or more than one first sound baffle positioned between the zone of interest and a first zone of the housing. The sound baffle is configured to reduce acoustic transmission from the first zone to the zone of interest.

The first sound baffle may comprise a radially extending baffle plate. The acoustic sensor may be deployed in the housing by a deployment line and the first sound baffle may comprise the sound baffle device of the first aspect.

The system may further comprise one or more than one second sound baffle positioned between the zone of interest and a second zone of the housing to reduce acoustic transmission from the second zone to the zone of interest. The first sound baffle and the second sound baffle may be positioned on either side of the zone of interest. The second sound baffle may comprise a radially extending baffle plate. The acoustic sensor may be deployed in the housing by a deployment line and the second sound baffle may comprises the sound baffle device of the first aspect.

This summary does not necessarily describe the entire scope of all aspects. Other aspects, features and advantages will be apparent to those of ordinary skill in the art upon review of the following detailed description.

BRIEF DESCRIPTION OF FIGURES

In the accompanying drawings, which illustrate one or more exemplary embodiments.

DETAILED DESCRIPTION

Directional terms such as "top", "bottom", "upwards", "downwards", "vertically" and "laterally" are used in the following description for the purpose of providing relative reference only, and are not intended to suggest any limitations on how any article is to be positioned during use, or to be mounted in an assembly or relative to an environment.

The embodiments described herein generally relate to a sound baffle device for use with an acoustic sensor and to a system for detecting acoustic signals in a zone of interest in a housing comprising an acoustic sensor and a sound baffle. The sound baffle may be used with an acoustic sensor deployed in a wellbore of an oil or gas well. Alternatively the sound baffle may be deployed with an acoustic sensor in a fluid storage vessel or other housing. The acoustic sensor may be an acoustic sensor array, a fibre optic cable or any other acoustic sensor used to detect acoustic signals in the wellbore, vessel or other housing. The acoustic information may be used to monitor and control downhole operations, for example to detect the creation and expansion of fractures during hydraulic fracturing or for other applications, such as intrusion detection or for seismic monitoring. Acoustic events can also be monitored to provide an indication of the presence and position of leaks in an oil or gas well or fluid storage vessel as is known in the art.

The sound baffle device of the described embodiments comprises a radially extending baffle plate and an affixing mechanism for affixing the baffle plate to a deployment line used to deploy an acoustic sensor in a housing. By 'affixing' the baffle plate to the deployment line it is meant that the baffle plate is coupled but not necessary secured to the deployment line, for example the baffle plate may be free to rotate on the deployment line and retained on the deployment line between two stoppers as described below with reference to FIG. 14, or the baffle plate may be releasably or fixedly attached to the deployment line.

Figure 1:
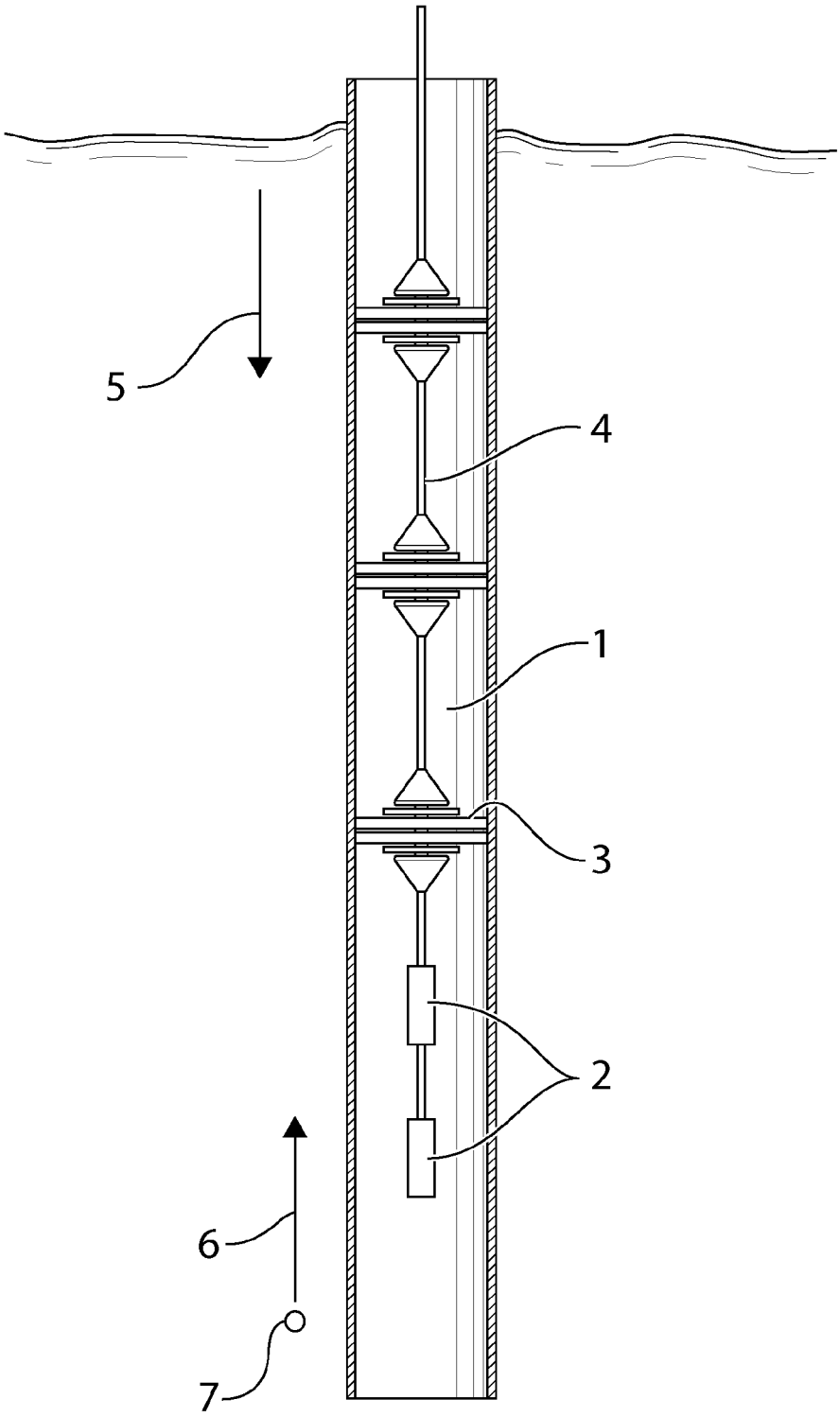
FIG. 1 is a schematic of a system for detecting acoustic signals in a zone of interest in a wellbore comprising an acoustic sensor and a plurality of sound baffle devices according to an embodiment.

Referring to the drawings and specifically to FIG. 1, there is shown an embodiment of a system for detecting acoustic signals in a zone of interest in a wellbore 1. Acoustic signals are detected by multiple acoustic sensors 2 attached to the distal end of a deployment line 4. Acoustic sensor 2 may be a sensor array as are known in the art, for example, but not limited to Hifi MiQro™ (aka LeakSonar™) and any number of acoustic sensors 2 may be positioned on the deployment line 4. Other acoustic sensors may be utilized as are known in the art and the acoustic sensor 2 may be an optical fiber deployed downhole in a wireline consisting of a metal or plastic tube surrounding the optical fiber to protect the fiber. The deployment line 4 may be any deployment line for deploying the acoustic sensor 2, for example, but not limited to a slickline, coiled tubing, tractor, braided line or a wireline containing an optical fiber. A surface data acquisition unit (not shown) may be used for receiving and processing raw measurement data from the acoustic sensor 2 as is known in the art.

A leak 7 in the well casing generates an acoustic signal (represented by arrow 6) which travels up the wellbore and is detected by acoustic sensor 2. The acoustic signal 6 generated by leak 7 may be small in comparison to acoustic signals generated from above the acoustic sensor 2 (represented by arrow 5). These downward-propagating sounds (hereafter referred to as 'above sounds 5') can be caused for example by well surface equipment, the flow of water in an underground stream located above the tool location, a loud gas leak above the tool location, etc. These loud above sounds 5 can overshadow acoustic signal 6 to the point where software algorithms may be incapable of detecting the presence of acoustic signal 6. Acoustic signals may also be generated by sounds occurring below the leak 7, for example there may be a underground stream below the acoustic sensor 2. These below generating sounds can also interfere or overshadow the acoustic signal 6 produced by leak 7.

In order to reduce transmission of above sounds 5 to acoustic sensor 2, multiple sound baffle devices 3 are affixed to the deployment line 4 above the acoustic sensor 2 to reduce acoustic transmission from a zone above the sound baffle devices 3 to a 'zone of interest' where the acoustic sensor 2 is positioned. In the embodiment shown in FIG. 1, three sound baffle devices 3 are attached to the deployment line 4 above the acoustic sensor 2, however only one or any number of sound baffle devices 3 may be attached to the deployment line 4 depending on the depth that the acoustic sensor 2 is being deployed in the wellbore and the amount of above sounds 5 being generated. In alternative embodiments (not shown), one or more sound baffle device 3 may be positioned below the acoustic sensor 2 if the operator wishes to block sounds generated below the acoustic sensor 2. The one or more sound baffle device 3 positioned below the acoustic sensor 2 may be in addition to or alternatively to the one or more sound baffle device 3 positioned above the acoustic sensor 2. For example, in a well with multiple leaks generating below sounds, a sound baffle device 3 may be positioned above and below the acoustic sensor 2 to define a 'zone of interest' between the two sound baffle devices 3 with the acoustic sensor 2 positioned in the zone of interest. The sound baffle devices 3 reduce acoustic transmission from above and below the zone of interest beneficially allowing the acoustic sensor 2 to detect acoustic signals generated within the zone of interest. The sound baffle device 3 may be located anywhere from a few centimeters to many meters from the acoustic sensor 2. Sound baffle device 3 effectively provides some level of acoustic isolation between zones on either side of the device 3 thereby aiding detection and identification of acoustic signals in the zone of interest by reducing transmission of acoustic signals from other zones of the wellbore into the zone of interest.

Referring now to FIGS. 2-12, there is shown an embodiment of the sound baffle device 3 attached to deployment line 4. Sound baffle device 3 comprises a body 10 having two conical portions 12 at both ends and a baffle plate assembly 14 attached thereto. Baffle plate assembly 14 includes a baffle plate 34 clamped between two retaining disks 33*a,b* which are in turn positioned between two retaining rings 38. The sound baffle device 3 is configured such that it can be releasably attached to the deployment line 4 of an existing acoustic sensing apparatus. As the sound baffle device 3 is physically attached to the deployment line 4, it will be lowered and removed from downhole along with the acoustic sensor 2 by deploying and retrieving the deployment line 4 from the wellbore. Multiple sound baffle devices 3 can be added in series in order to increase attenuation of undesired sounds in the wellbore. In alternative embodiments, the sound baffle device 3 may be attached to a deployment line 4 used to deploy acoustic sensor 2 in other types of housing, such as a fluid storage vessel.

Figure 4:
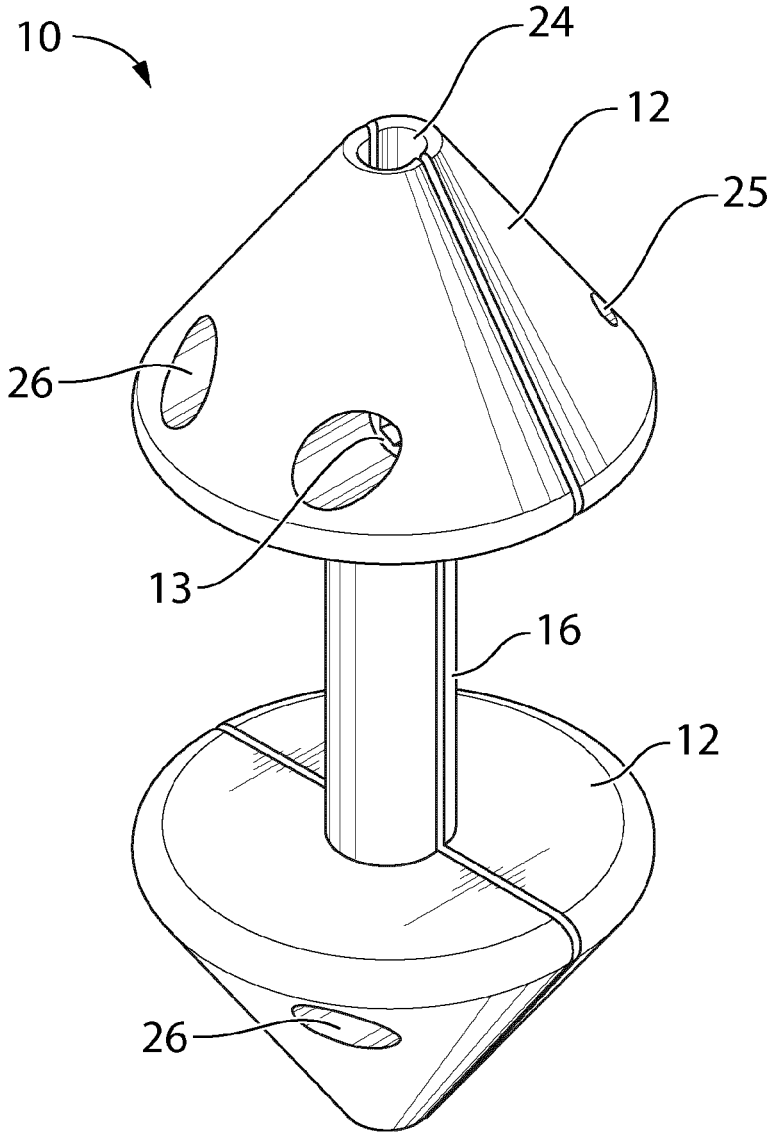
FIG. 4 is a perspective view of the assembled body of FIG. 3.
Figure 5:
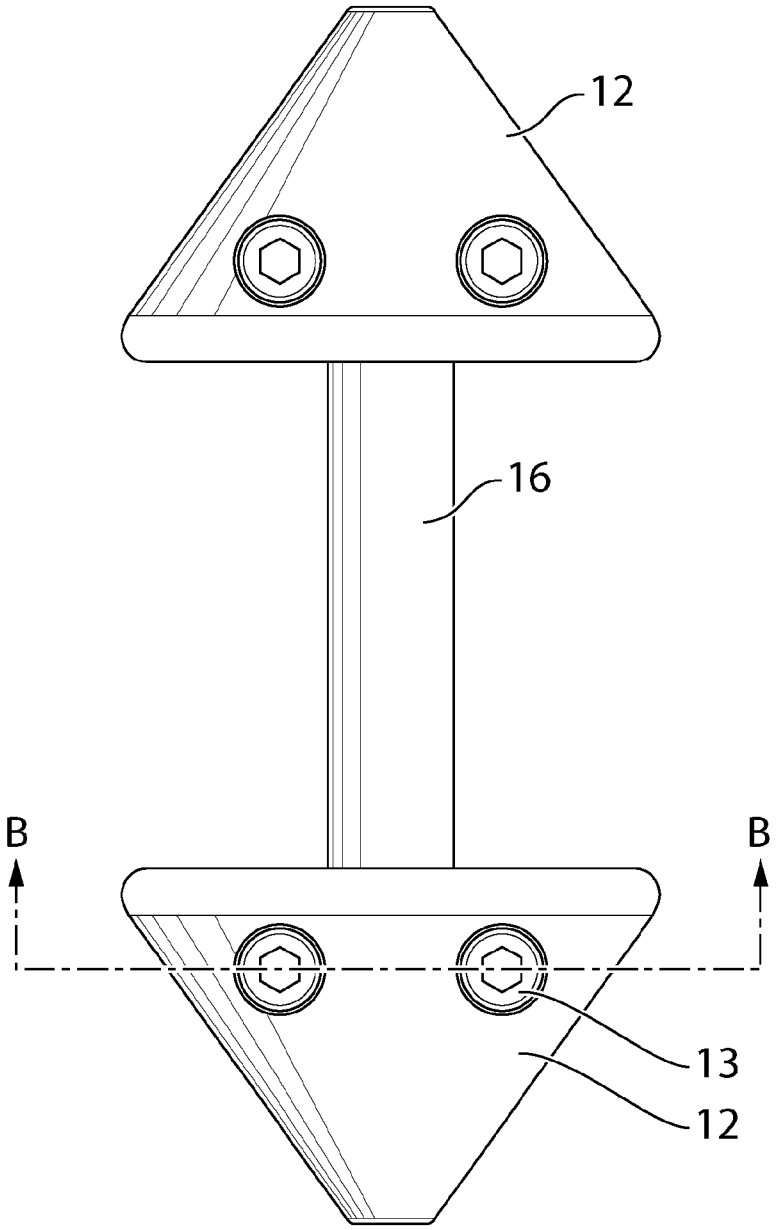
FIG. 5 is a side view of the assembled body of FIG. 4.
Figure 6:
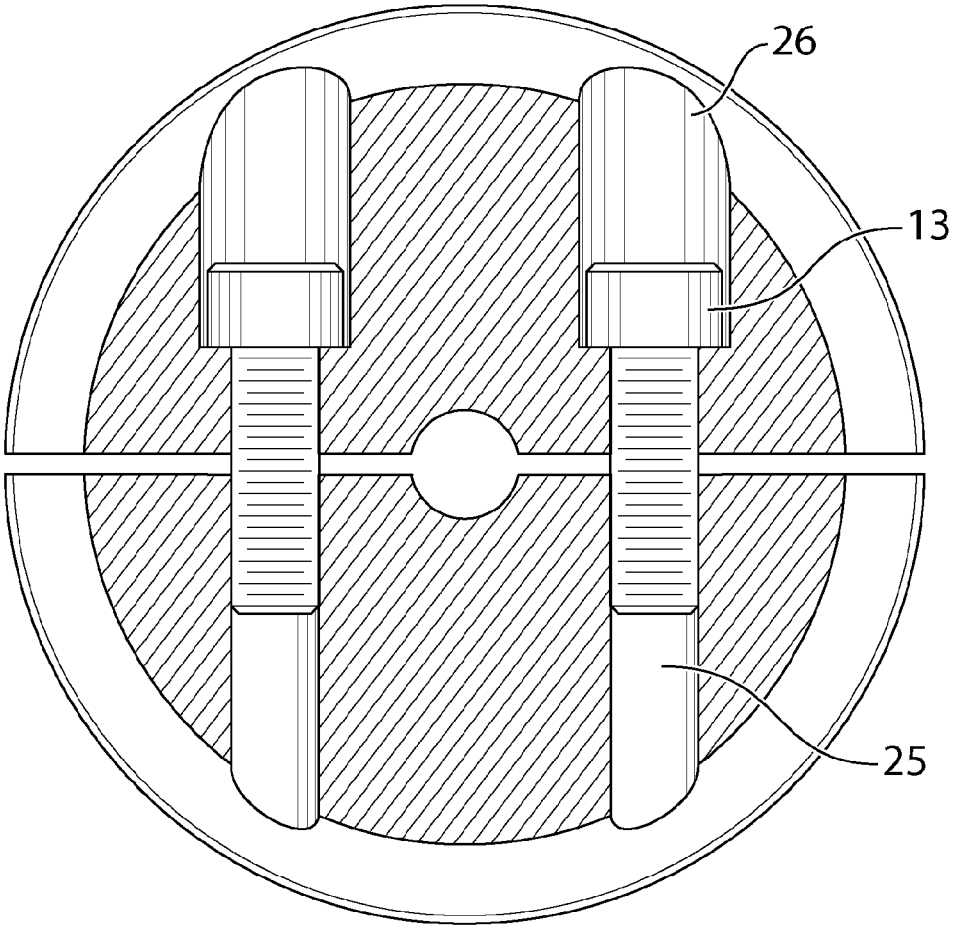
FIG. 6 is a cross-sectional view through line B-B of FIG. 5.
Figure 7:
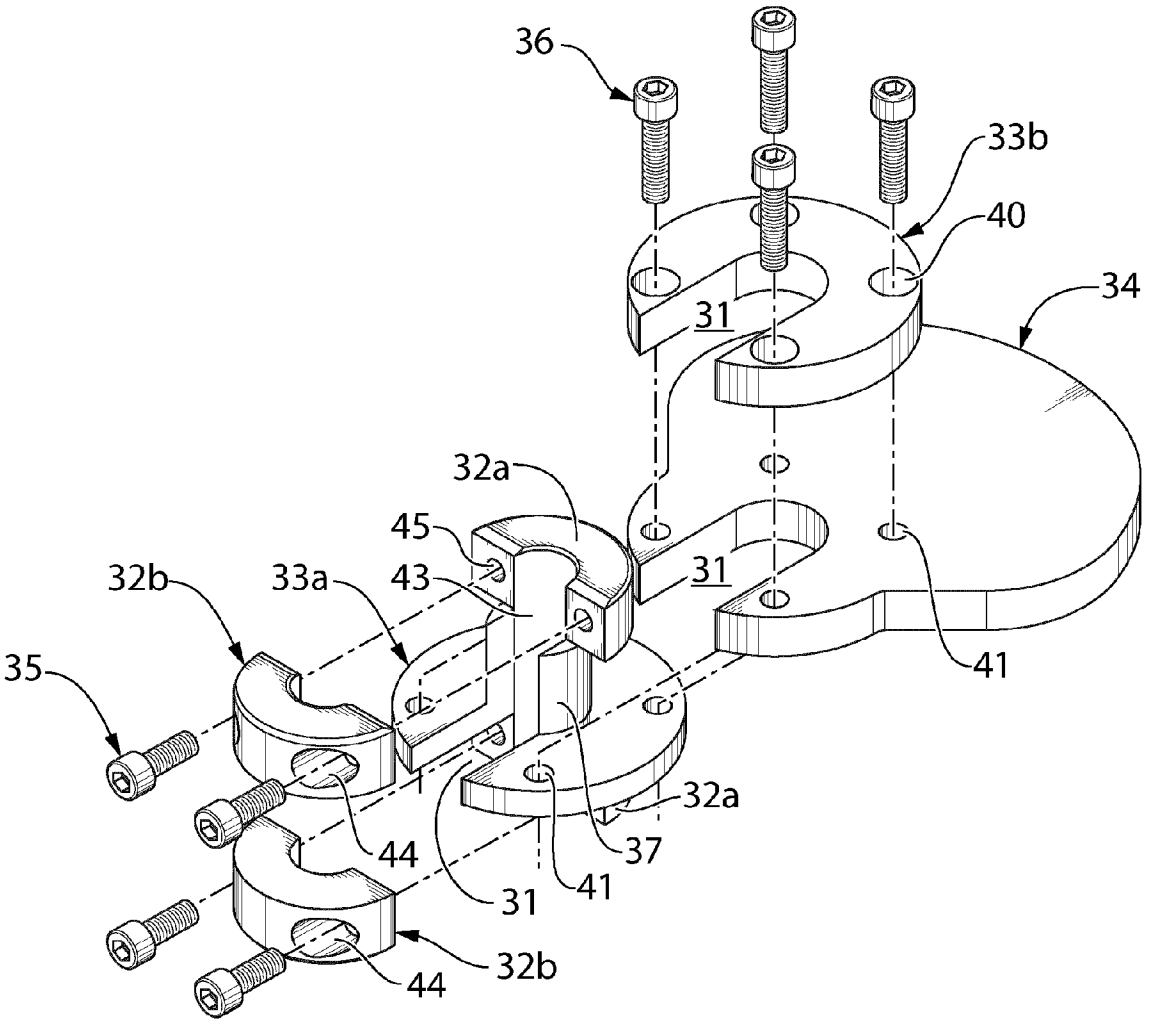
FIG. 7 is a perspective expanded view of the baffle plate assembly of the sound baffle device of FIG. 2.

The body 10 of the sound baffle device 3 comprises two conical portions 12 with a leg portion 16 extending therebetween as shown in FIG. 4. The body 10 is made from two sections 21 which are releasably secured together around the deployment line 4 to form the body 10. Each section 21 includes an upper conical section 27, a lower conical section 28 with a leg section 22 extending therebetween. An inner facing surface 29 of each section 21 is flat and has a longitudinally extending channel or groove 23 along the surface thereof. To assemble the body 10, the inner facing surfaces 29 of the two sections 21 are aligned together around the deployment line 4. The grooves 23 form aperture 24 which is dimensioned to snugly receive the deployment line 4. Threaded screws 13 inserted into screw holes 26 engage threaded channels 25 (as shown in FIG. 6) to clamp the two sections 21 together and releasably fasten the sections 21 together around the deployment line 4 to form body 10. In alternative embodiments (not shown) other fasteners for releasably or fixedly fastening the two sections 21 together may be used, for example a clamping mechanism or bolts. In further alternative embodiments, the body 10 may have a different configuration, for example, the conical portions 12 need not be present. The function of the body 10 is to releasably or fixedly attach the baffle plate 34 to the deployment line 4.

Figure 2:
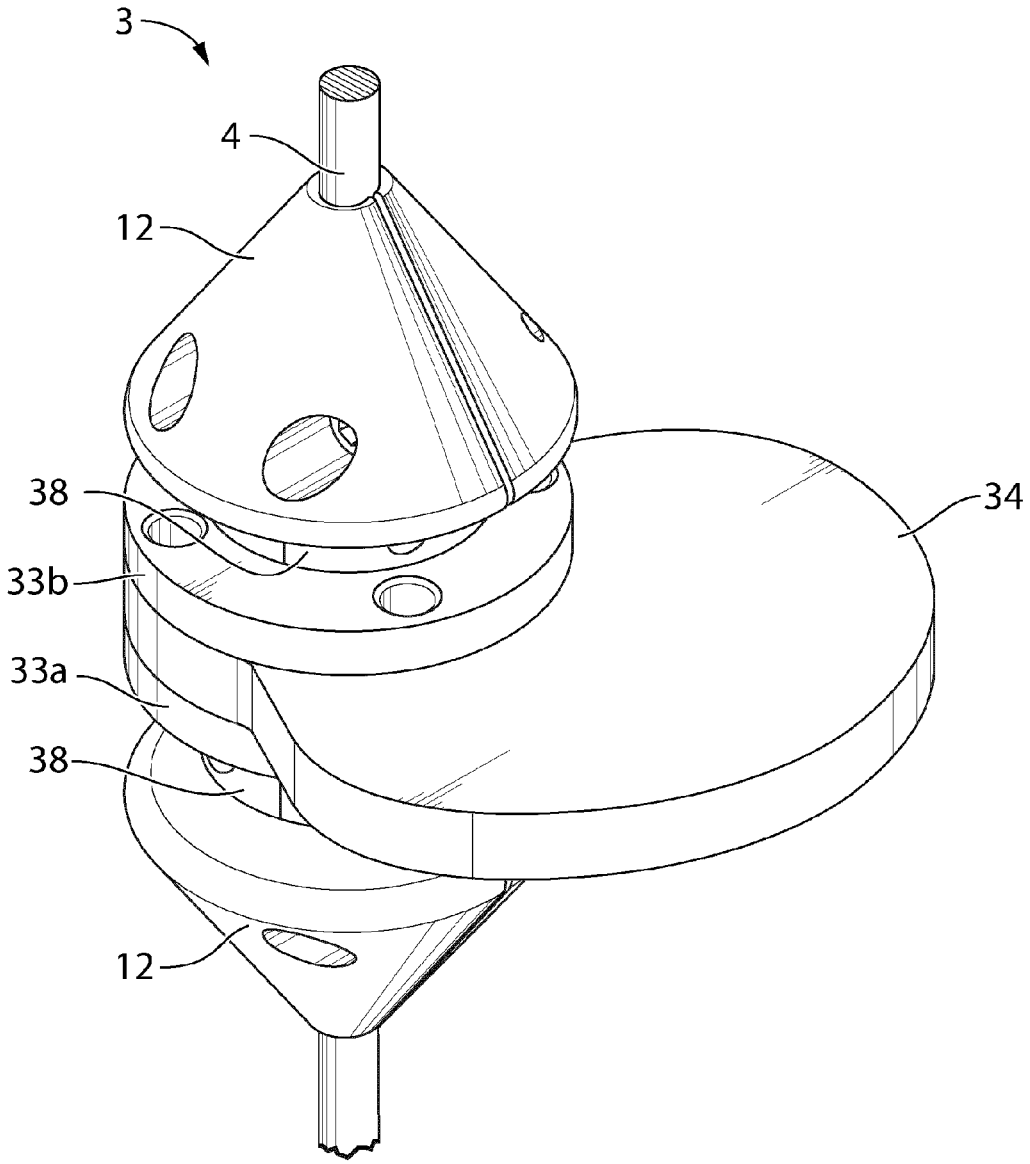
FIG. 2 is a perspective view of a sound baffle device according to an embodiment comprising a body with a baffle plate assembly attached thereto.
Figure 3:
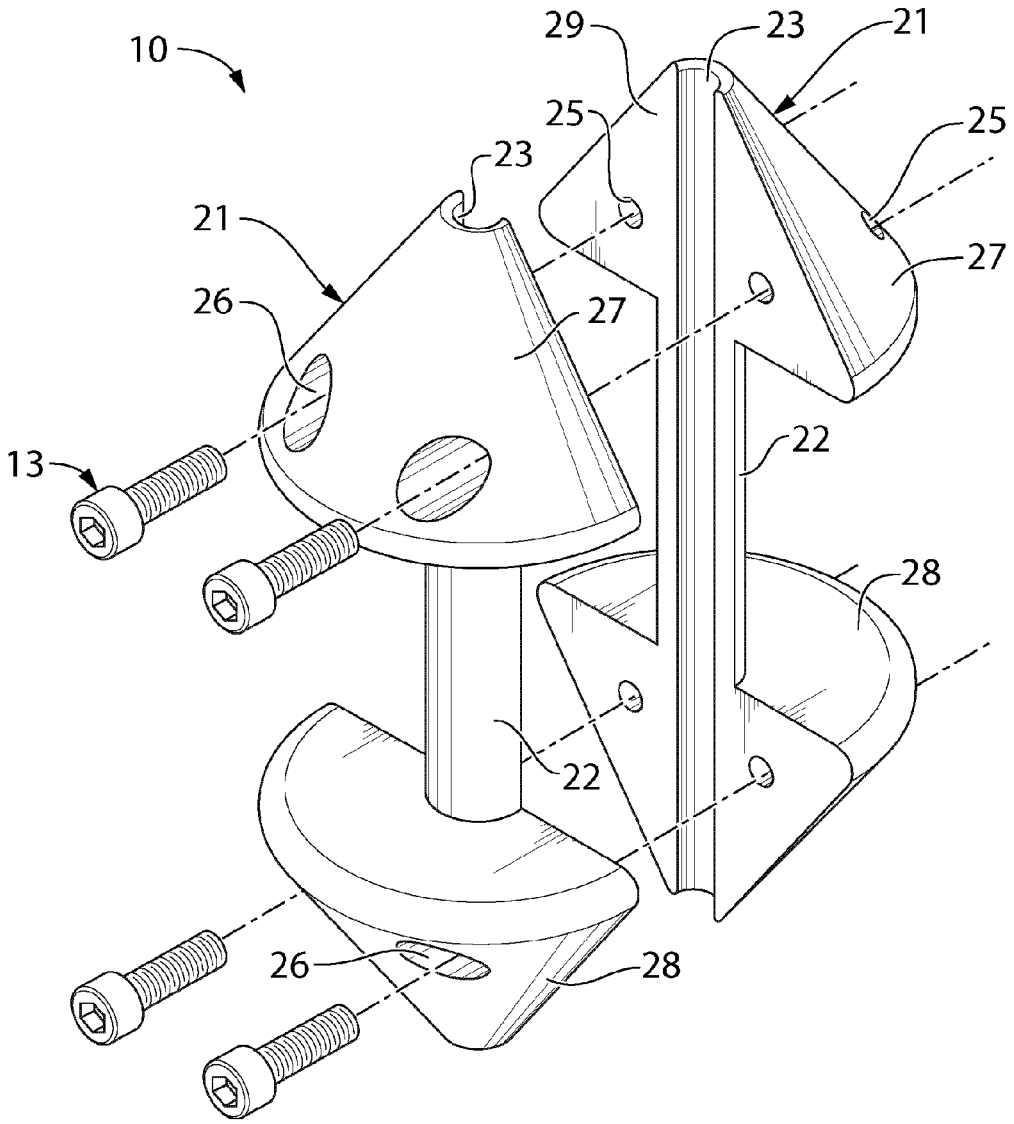
FIG. 3 is a perspective expanded view of the body of the sound baffle device of FIG. 2.
Figure 8:
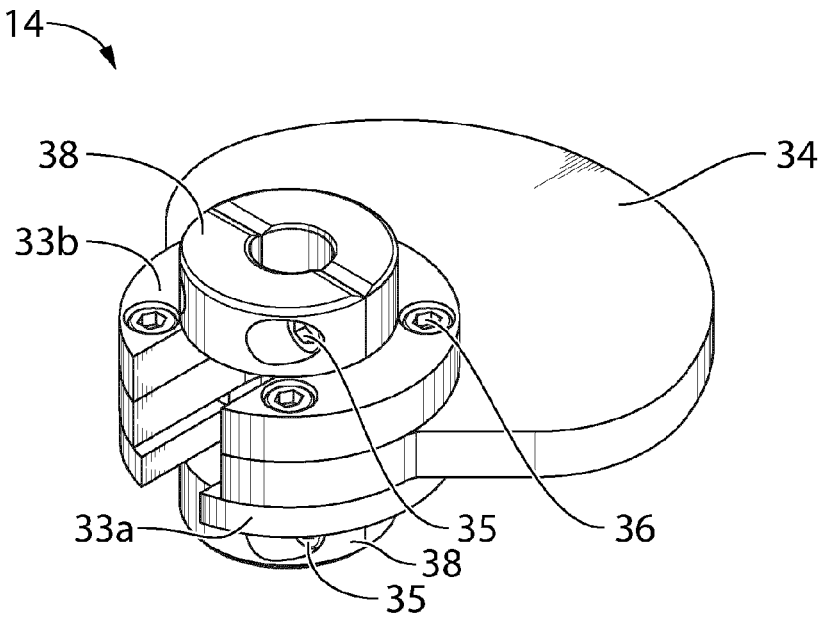
FIG. 8 is a perspective view of the assembled baffle plate assembly of FIG. 7.
Figure 9:
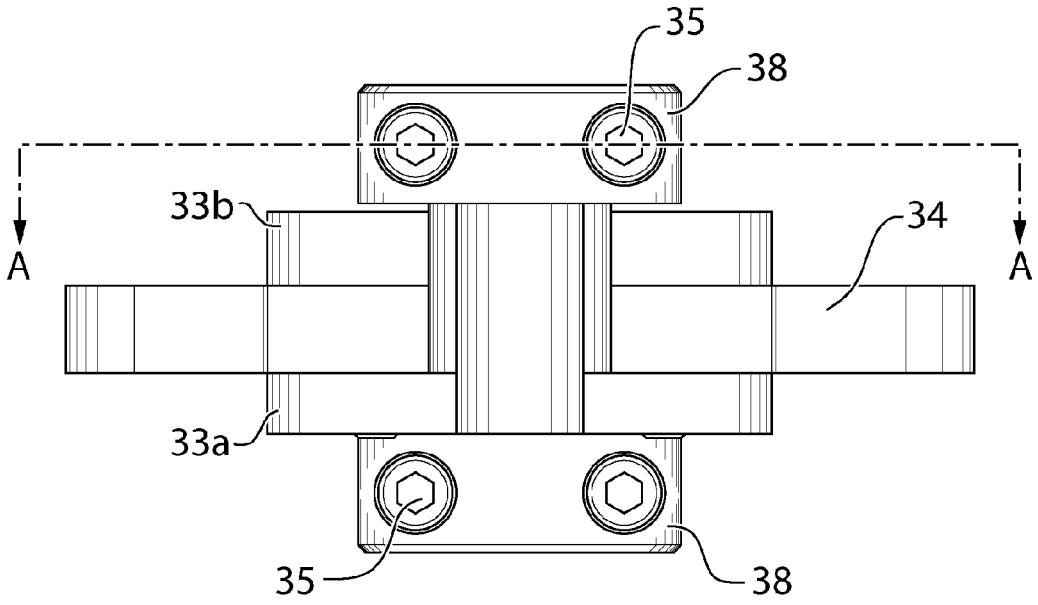
FIG. 9 is a side view of the assembled baffle plate assembly of FIG. 8.
Figure 10:
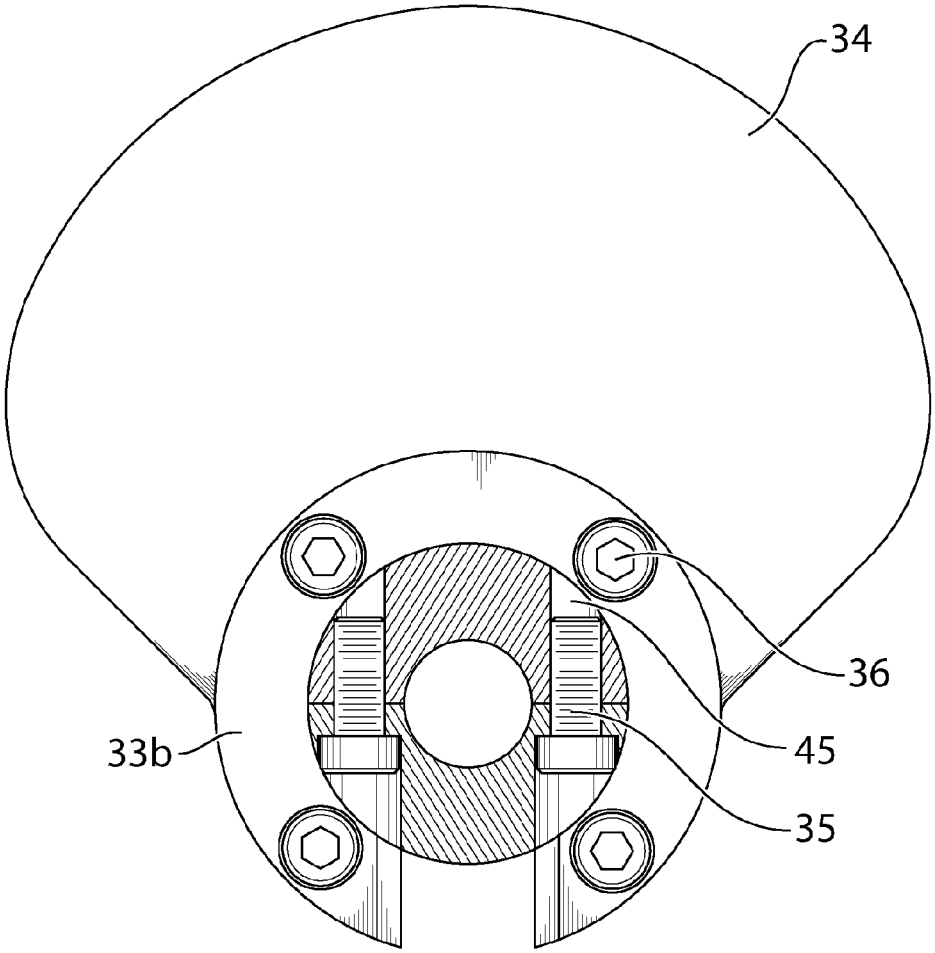
FIG. 10 is a cross-sectional view through line A-A of FIG. 9.
Figure 11:
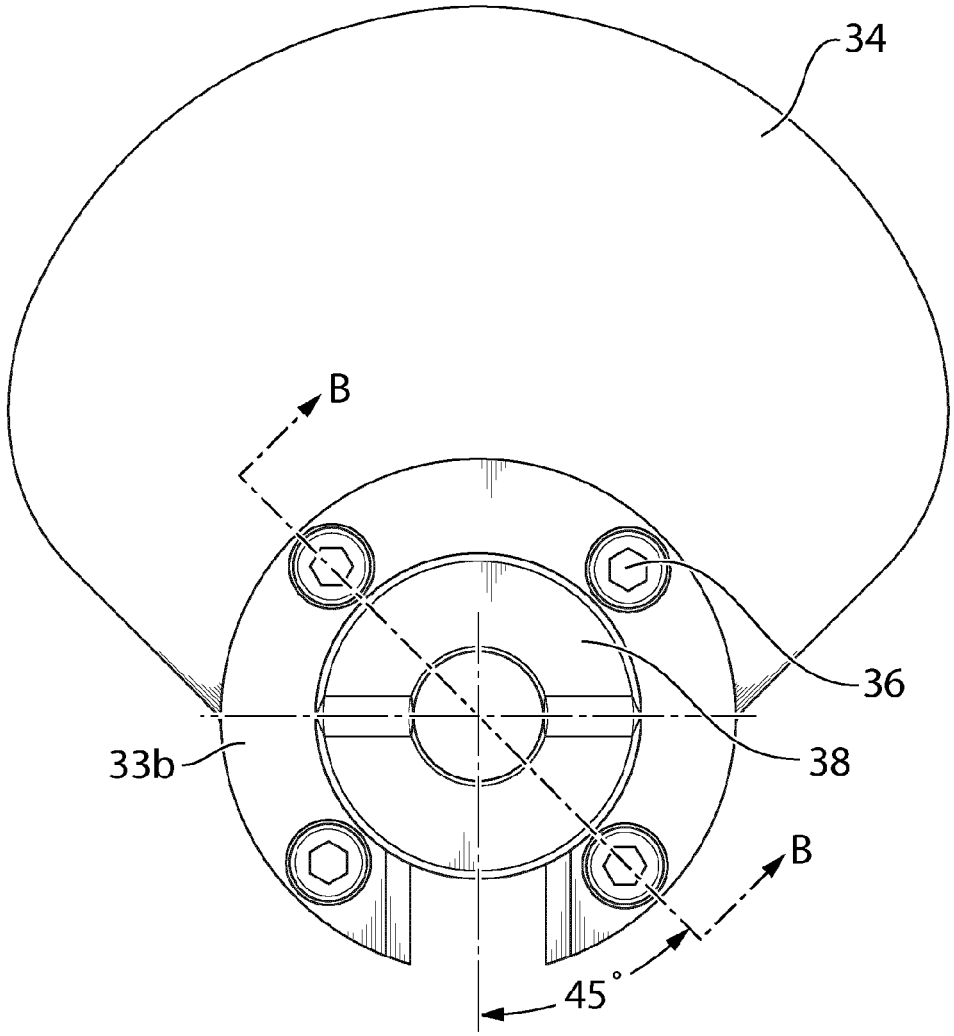
FIG. 11 is a top view of the assembled baffle plate assembly of FIG. 8.
Figure 12:
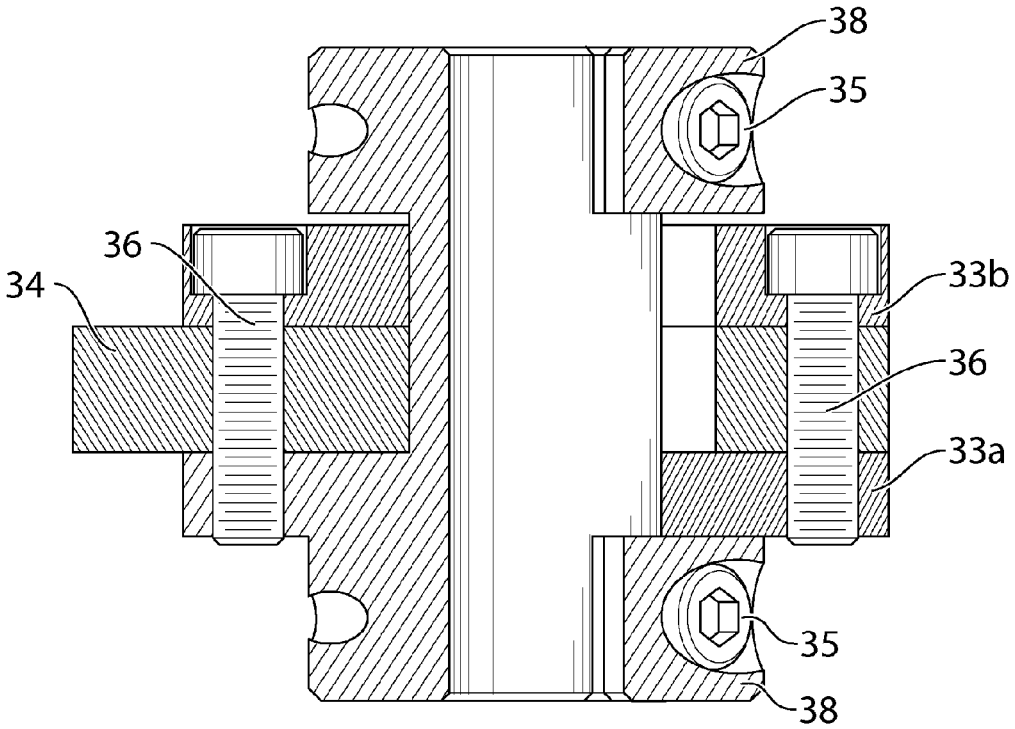
FIG. 12 is a cross-sectional view through line B-B of FIG. 11.

The baffle plate assembly 14 of the sound baffle device 3 includes the radially extending baffle plate 34 held in position by retaining discs 33*a,b* and retaining rings 38 as shown in FIG. 8. Baffle plate assembly 14 is made up of a body section 37 which incorporates one of the retaining discs 33*a* as well as half sections 32*a* of both retaining rings 38 at either end thereof. The baffle plate 34 includes a notch 31 and part of the body section 37 slots into the notch 31 with the baffle plate 34 sitting on retaining disc 33*a*. The other retaining disc 33*b* is then slotted into place so that a portion of the baffle plate is positioned between the two retaining discs 33*a,b*. Screw holes 40 in retaining disc 33*b* receive threaded screws 36. Treaded channels 41 through the baffle plate 34 and retaining disc 33*a* align to engage threaded screws 36 (as shown in FIG. 12) to releasably attach the baffle plate 34 in position on the body section 37. The notch 31 of the baffle plate 34 lines up with notches 31 in both of the retaining discs 33*a,b* so that the leg portion 16 of the body 10 is received by the notches 31 and positioned in a longitudinally extending channel 43 in the body section 37. Two retaining ring half sections 32*b* mate with the two retaining ring half sections 32*a* incorporated in body section 37. Threaded screws 35 inserted in screw holes 44 engage threaded channels 45 to releasably secure the retaining ring half sections 32*a,b* together as shown in FIG. 10 to form retaining rings 38. The two retaining rings 38 thereby releasably attach the baffle plate assembly 14 to the leg portion 16 of body 10 to form the assembled sound baffle device 3 as shown in FIG. 2.

In alternative embodiments (not shown) the baffle plate assembly 14 may have a different configuration which functions to fixedly or releasably attach the baffle plate 34 to the body 10. In further alternative embodiments, the baffle plate 34 may be directly attached to the body 10 without requiring the rest of the assembly parts. In further alternative embodiments, the body 10 and the baffle plate 34 may be a unitary structure configured for attachment to the deployment line 4. For example, the body may comprise two section which are configured to be fastened together to surround the deployment line 4 and one of the body sections may include the baffle plate 34 as a unitary structure. The innovative aspects apply equally in embodiments such as these.

Conical portions 12 provide a smooth surface of increasing dimension at either end of the sound baffle device 3. This may beneficially aid in deployment and withdrawal of the device 3 from the wellbore, without the device getting snagged on equipment or formations within the wellbore. The conical portions 12 may be made of stainless steel or another resistant metal able to withstand the downhole environment and any knocks the conical portions 12 receive while the device 3 is being deployed and withdrawn from the wellbore. Other parts of the device, such as the leg portion 16, body section 37, retaining discs 33*a,b* and retaining rings 38 may be made of a softer, less resistant metal, for example, but not limited to brass that is beneficially less likely to bind to the wellbore casing.

Baffle plate 34 is typically made of a sound insulating material, for example, but not limited to, urethane rubber or silicone. The material may be chosen to absorb as much sound as possible with minimal reflection or passage of sound through the material. Additionally, the baffle plate material may be chosen to be able to withstand the high temperatures encountered downhole and is optionally moisture resistant and flexible. A flexible baffle plate may beneficially permit fluid to pass by the edges of the baffle plate when the baffle plate is positioned downhole and may also have the benefit of not impeding logging tools being rigged in or out of the wellbore. The baffle plate 34 may be made of closed cell foam or it may be made of layers of different material, for example, a layer of one material may be sandwiched between two layers of a different material. Alternatively, the baffle plate 34 may be made of moulded plastic or spherical balls.

The outer dimensions of the baffle plate 34 may be configured to be similar to the inner dimension of the wellbore casing, so that the baffle plate 34 extends across much of the cross-section of the wellbore to beneficially mitigate sound transfer through the wellbore as much as possible. Sound baffle device 3 attached to deployment line 4 can generally rotate whilst being deployed downhole to accommodate cables and other logging tools. The flexible baffle plate 34 permits fluid to flow around the baffle plate 34. In the embodiments shown in FIGS. 2 and 7-13, the baffle plate 34 is shaped to radially extend out on an opposed side to the notch 31 in the baffle plate, such that when the device 3 is deployed downhole the device 3 is positioned with the notch 31 near one side of the wellbore and the baffle plate 34 extends towards the opposite side. In alternative embodiments (not shown) the baffle plate 34 may be configured differently and still have the same effect of reducing transmission of acoustic signals along the wellbore, for example the baffle plate 34 may be centrally positioned, with the notch 31 extending from the center to the edge of baffle plate 34 so that the leg portion 16 is received central to the baffle plate 34.

Figure 13:
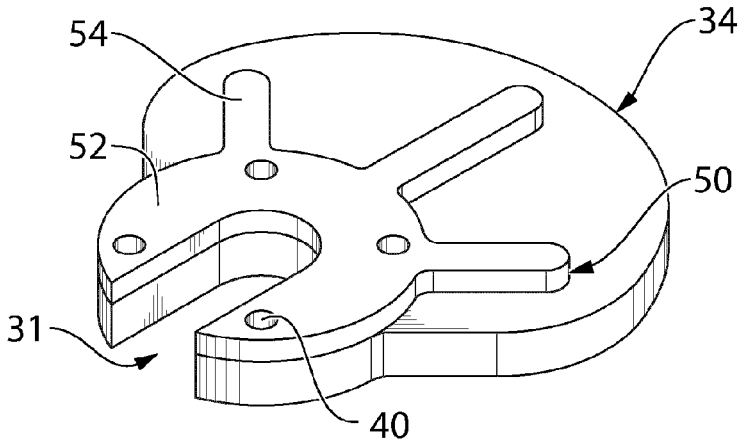
FIG. 13 is a perspective view of a baffle plate according to an embodiment.

Referring now to FIG. 13, there is shown an alternative embodiment of baffle plate 34 which includes a stiffener 50 attached to one face of the baffle plate 34. The stiffener 50 may be made of metal or may be made of plastic, for example, but not limited to, a semi-rigid urethane plastic. The stiffener 50 has a disc shaped body 52 with extending fingers 54 which strengthens the baffle plate 34. The baffle plate 34 may be attached to stiffener 50 by an adhesive or some other attachment means. Stiffener 50 may replace retainer disc 33*b* or it may be used in conjunction with retainer disc 33*b*. As with retainer disc 33*b*, stiffener 50 has a notch 31 to enable the body section 37 to slot into the notch 31, and screw holes 40 to receive threaded screws 36 which releasably attach the stiffener 50 and baffle plate 34 to retainer disc 33*a*. In alternative embodiments (not shown) a stiffener 50 may be provided on both sides of the baffle plate 34 either in addition to or to replace retainer discs 33*a,b*.

Figure 14:
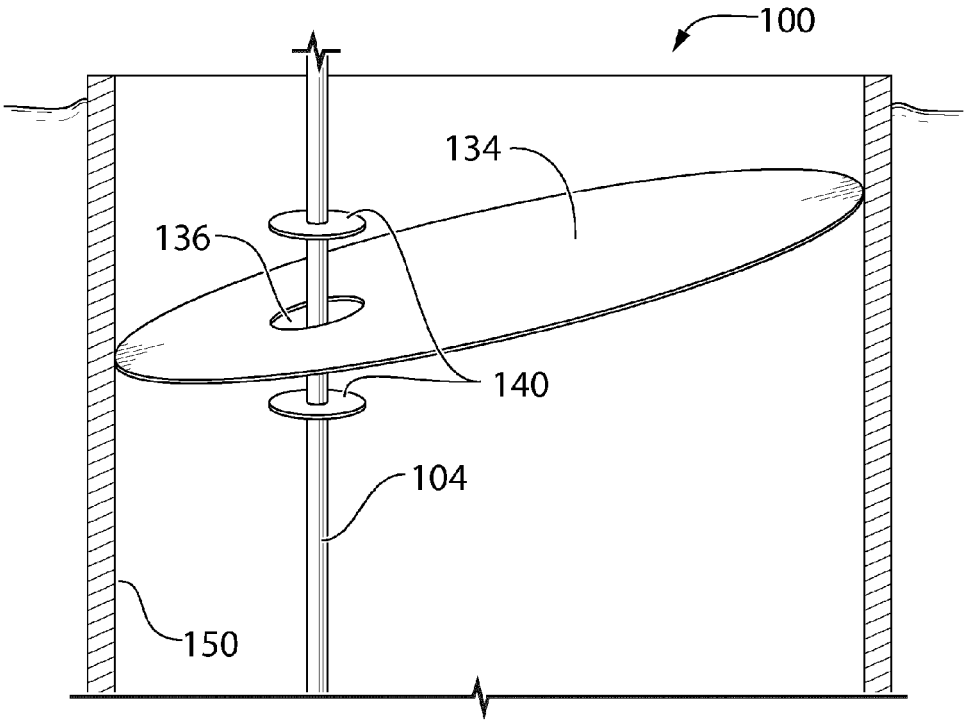
FIG. 14 is a schematic of a sound baffle device according to another embodiment.
Figure 15:
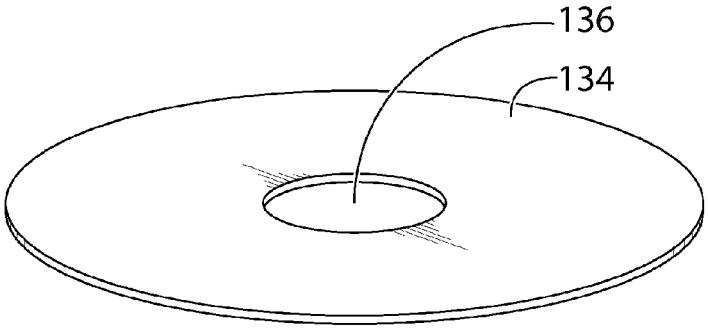
FIG. 15 is a schematic of a baffle plate according to another embodiment.

Referring now to FIG. 14, there is shown another embodiment of a sound baffle device 100 including a radially extending baffle plate 134 and ringed stoppers 140 which affix the baffle plate 134 to a deployment line 104 of an acoustic sensing apparatus. The deployment line 104 may be a slickline, coiled tubing, tractor, braided line, wireline containing an optical fiber or other deployment line as are known in the art. The baffle plate 134 is ellipse shaped and has an aperture 136 therethrough which receives the deployment line 104. The two ringed stoppers 140 are positioned on the deployment line 104 either side of the baffle plate 134 and retain the baffle plate 134 on the deployment line 104. The aperture 136 of the baffle plate 134 is larger than the diameter of the deployment line 104 such that the baffle plate 134 is free to move and rotate on the deployment line 104 between the two stoppers 140. The deployment line 104 with the sound baffle device 100 attached thereon is deployed in a housing 150, such as a tubular or riser of a wellbore or a fluid storage vessel to reduce transmission of acoustic signals from one side of the baffle plate to the other side of the baffle plate. The major axis of the ellipse shaped baffle plate 134 is greater than the inner diameter of the housing 150 so that the baffle plate 134 is tilted within the housing. Providing an ellipse shaped baffle plate 134 may beneficially help the acoustic sensing apparatus rest in a more natural position without being forced into the center. The baffle plate 134 can rotate around the deployment line 104 as necessary until the acoustic sensing apparatus settles in its natural position within the housing 150. In the embodiment shown in FIG. 14, the aperture 136 of the baffle plate is positioned off-centre and the deployment line 104 is correspondingly positioned off-centre within the housing 150. In an alternative embodiment shown in FIG. 15, the aperture 136 of the ellipse shaped baffle plate 134 is centrally positioned and the deployment line on which the baffle plate 134 is affixed is centrally positioned within the housing. The major axis of the ellipse shaped baffle plate 134 shown in FIG. 15 may also be greater than the inner diameter of the housing down which it is being deployed and the baffle plate 134 may be flexible enough for the sides of the baffle plate to fold up against the housing (not shown). The major axis of the ellipse shaped baffle plate can range from 1d to 2d, where 'd' is the inner diameter of the housing. In alternative embodiments (not shown) the baffle plate 134 may be circular, oval or some other radially extending shape and may have a diameter that is the same or less than the inner diameter of the housing in which it is deployed.

In an alternative embodiment (not shown), the stoppers 140 may not be present and the baffle plate 134 may include alternative means for attaching the baffle plate 134 to the deployment line 104. For example, an o-ring, packing or other gasket may be positioned between the baffle plate 134 and the deployment line 104. The gasket may be seated in a groove in a surface defining the aperture 136 of the baffle plate 134 and compressed to form a seal between the baffle plate 134 and the deployment line 104 to retain the baffle plate 134 in position on the deployment line 104.

Figure 16:
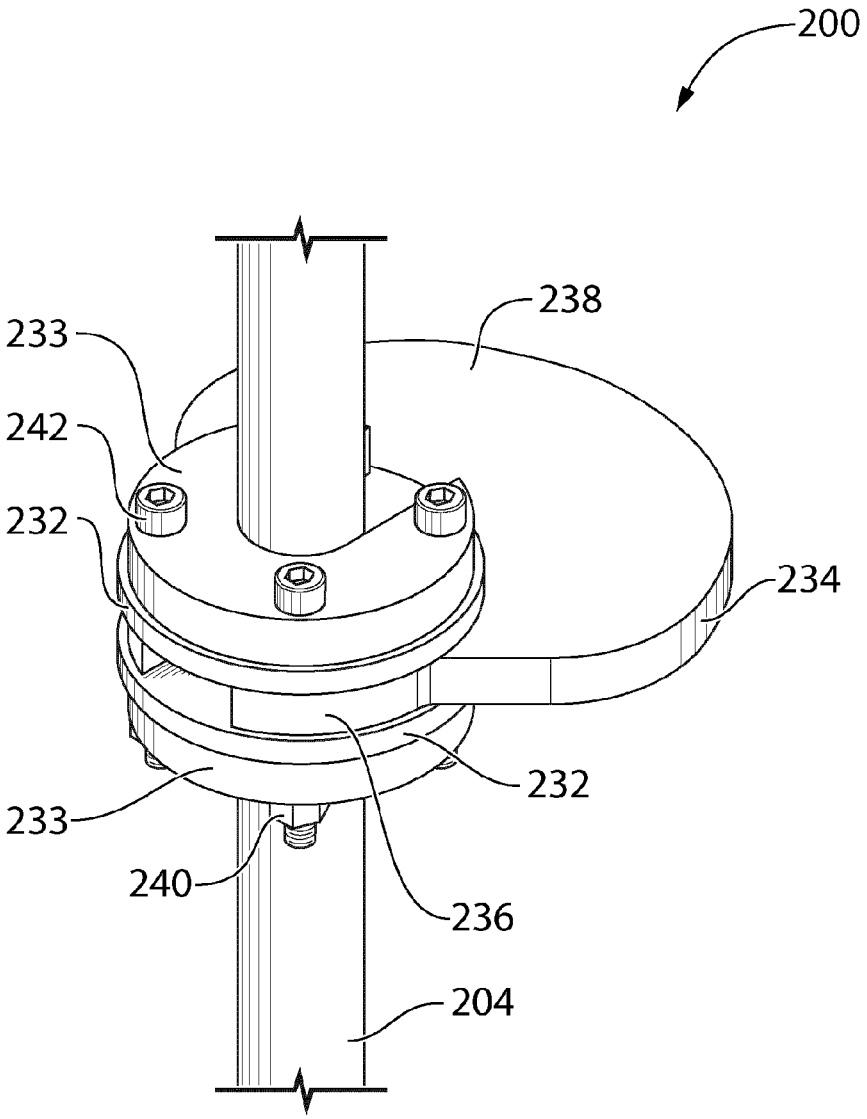
FIG. 16 is a perspective view of a sound baffle device according to another embodiment.
Figure 17:
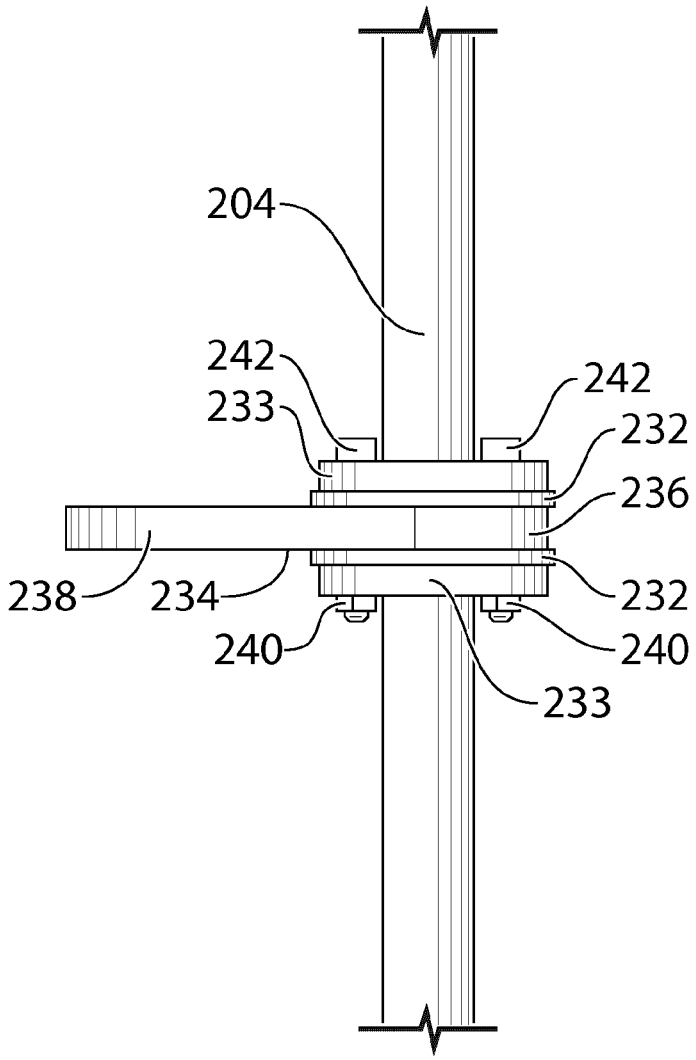
FIG. 17 is a side view of the device of FIG. 16.

Referring now to FIGS. 16 and 17, there is shown another embodiment of a sound baffle device 200 including a baffle plate 234 which is releasably attached to a deployment line 204 of an acoustic sensing apparatus. The deployment line 204 may be a slickline, coiled tubing, tractor, braided line, wireline containing an optical fiber or other deployment line as are known in the art. The baffle plate 234 is similar to baffle plate 34 in FIGS. 2 and 7-12 and includes an attachment portion 236 and a larger radially extending portion 238. A notch in the attachment portion 236 receives the deployment line 204 while the radially extending portion 238 extends across substantially the full cross sectional area of housing in which the device 200 is deployed to reduce transmission of acoustic signals from one side of the baffle plate to the other side of the plate. A ring-shaped packing 232 is positioned either side of the baffle plate attachment portion 236. The packing 232 includes a notch which lines up with the notch of the baffle plate attachment portion 236 and receives the deployment line 204. A retaining disc 233 is positioned either side of the packing 232. The retaining discs 233 each also include a notch to receive the deployment line 204, however the notch of the retaining discs is on an opposed side to the notches in the baffle plate attachment portion 236 and the packing 232 when the device 200 is fully assembled on the deployment line 204 so as to retain the baffle plate 234 on the deployment line 204. Holes through each of the retaining discs 233, ring-shaped packing 232 and baffle plate attachment portion 236 line up to provide channels (not shown) which receive bolts 242. Nuts 240 screw onto bolts 242 and are tightened to move the retaining discs 233 towards each other and compress the packing 232 to releasably secure the baffle plate 234 on the deployment line 204. An alternative compressor, such as clamps or threaded screws, may be used to move the retaining discs 233 towards each other and compress the packing 232 so as to fixedly or releasable secure the baffle plate 234 on deployment line 204. The packing material may be any compressible or deformable material such as an elastomer which compresses under tension to secure the baffle plate 234 in position on deployment line 204. In an alternative embodiment (not shown) only one of the retaining discs 233 and one ring shaped packing 232 may be used and the compressor (such as bolts 242 and nuts 240) is used to move the retaining disc 233 toward the baffle plate 234 to compress the packing 232 therebetween and secure the baffle plate 234 on deployment line 204.

Provision of notches in the baffle plate attachment portion 236, retaining discs 233 and ring-shaped packing 232 allows the sound baffle device 200 to be attached to an existing deployment line 204. In alternative embodiments however, the baffle plate 234, retaining discs 233 and packing 232 may not include a notch and may instead have an aperture therethrough for receiving the deployment line, in which case the device will need to be positioned on the deployment line 204 during set up.

While particular embodiments have been described in the foregoing, it is to be understood that other embodiments are possible and are intended to be included herein. It will be clear to any person skilled in the art that modification of and adjustments to the foregoing embodiments, not shown, are possible.

The invention claimed is:

1. A sound baffle device for use with an acoustic sensor deployed in a housing by a deployment line, the sound baffle device comprising:

(a) a baffle plate, wherein the baffle plate is configured to reduce acoustic transmission between a first zone of the housing on one side of the baffle plate and a second zone of the housing on an opposite side of the baffle plate; and (b) an affixing mechanism for affixing the baffle plate on the deployment line, wherein the affixing mechanism comprises a body configured to attach the baffle plate to the deployment line, wherein the body comprises a lower portion having a base, an upper portion having a base, and a leg portion extending between the base of the lower portion and the base of the upper portion, wherein a width of the leg portion is less than a width of the base of the lower portion and less than a width of the base of the upper portion, wherein the body comprises two or more sections and one or more fasteners for fastening the two or more sections together around the deployment line, wherein, when the two or more sections are fastened around the deployment line, the two or more sections define the lower portion, the upper portion, and the leg portion of the body, and wherein the baffle plate is attached to the leg portion and extends radially therefrom; and (c) a baffle plate assembly for attaching the baffle plate to the body, wherein the baffle plate assembly releasably attaches the baffle plate to the body.

2. The device of claim 1, wherein the baffle plate has an aperture therethrough for receiving the deployment line and the affixing mechanism comprises a first and second stopper configured to be positioned on the deployment line either side of the baffle plate such that in use the baffle plate is retained on the deployment line between the first and second stopper.

3. The device of claim 1, wherein the aperture of the baffle plate is dimensioned to allow rotation of the baffle plate around the deployment line.

4. The device of claim 1, wherein the one or more fasteners, releasably fasten the two or more sections together around the deployment line.

5. The device of claim 1, wherein the affixing mechanism comprises a compressible packing configured to compress and retain the baffle plate on the deployment line.

6. The device of claim 5, wherein the affixing mechanism further comprises a retainer and a compressor, wherein the packing is positioned between the retainer and the baffle plate and the compressor is configured to move the retainer towards the baffle plate and compress the packing therebetween.

7. The device of claim 6, wherein a first compressible packing is positioned on one side of the baffle plate and a second compressible packing is positioned on an opposed side of the baffle plate and wherein a first and second retainer are positioned on either side of the first and second packing and the compressor is configured to move the first and second retainer towards each other to compress the first and second packing therebetween.

8. A method of reducing acoustic transmission between a first zone of a wellbore and a second zone of a wellbore, the method comprising deploying a sound baffle device down the wellbore by a deployment line and positioning the sound baffle device between the first zone and the second zone to reduce acoustic transmission therebetween, wherein the sound baffle device comprises:

(a) a baffle plate, wherein the baffle plate is configured to reduce acoustic transmission between the first zone of the housing on one side of the baffle plate and the second zone of the housing on an opposite side of the baffle plate;

(b) an affixing mechanism that affixes the baffle plate on the deployment line, wherein the affixing mechanism comprises a body configured to attach the baffle plate to the deployment line, wherein the body comprises a lower portion having a base, an upper portion having a base, and a leg portion extending between the base of the lower portion and the base of the upper portion, wherein a width of the leg portion is less than a width of base of the lower portion and less than a width of the base of the upper portion, wherein the body comprises two or more sections and one or more fasteners for fastening the two or more sections together around the deployment line, wherein, when the two or more sections are fastened around the deployment line, the two or more sections define the lower portion, the upper portion and the leg portion of the body, and wherein the baffle plate is attached to the leg portion and extends radially therefrom; and (c) a baffle plate assembly for attaching the baffle plate to the body, wherein the baffle plate assembly releasably attaches the baffle plate to the body.

9. A system for detecting acoustic signals in a zone of interest in a housing, the system comprising:

(a) an acoustic sensor positioned in the zone of interest;

(b) a deployment line, wherein the acoustic sensor is attached to the deployment line;

(c) one or more first sound baffles positioned between the zone of interest and a first zone of the housing, the one or more first sound baffles configured to reduce acoustic transmission from the first zone to the zone of interest; and (d) one or more affixing mechanisms affixing the one or more first sound baffles to the deployment line, wherein each affixing mechanism comprises a body configured to attach an associated first sound baffle to the deployment line, and wherein the body comprises a lower portion having a base, an upper portion having a base, and a leg portion extending between the base of the lower portion and the base of the upper portion, wherein a width of the leg portion is less than a width of base of the lower portion and less than a width of the base of the upper portion, wherein the body comprises two or more sections and one or more fasteners for fastening the two or more sections together around the deployment line, wherein, when the two or more sections are fastened around the deployment line, the two or more sections define the lower portion, the upper portion and the leg portion of the body, and wherein the associated first sound baffle is attached to the leg portion; and (c) one or more baffle plate assemblies for attaching the one or more baffle plates to one or more respective bodies of the one or more affixing mechanisms, wherein the one or more baffle plate assemblies releasably attach the one or more baffle plates to the one or more bodies.

10. The system of claim 9, wherein the one or more first sound baffles comprise one or more baffle plates, and wherein each baffle plate extends radially from an associated leg portion.

11. The system of claim 9, wherein the one or more first sound baffles comprise:

(a) one or more baffle plates, wherein each baffle plate extends radially from an associated leg portion, wherein the one or more baffle plates are configured to reduce acoustic transmission between the first zone on one side of the one or more baffle plates and the zone of interest on an opposite side of the one or more baffle plates.

12. The system of claim 9, further comprising one or more second sound baffles positioned between the zone of interest and a second zone of the housing to reduce acoustic transmission from the second zone to the zone of interest, whereby the one or more first sound baffles and the one or more second sound baffles are positioned on either side of the zone of interest.

13. The system of claim 12, wherein the one or more second sound baffles comprise one or more baffle plates.

14. The system of claim 12, wherein the one or more second sound baffles comprise:

(a) one or more baffle plates, wherein the one or more baffle plates are configured to reduce acoustic transmission between the second zone on one side of the one or more baffle plates and the zone of interest on an opposite side of the one or more baffle plates.

* * * * *